US005526590A

United States Patent [19]

Palm et al.

[11] Patent Number: 5,526,590

[45] Date of Patent: Jun. 18, 1996

[54] TRENCH COMPACTOR

[75] Inventors: Harlan A. Palm, Grove City; Melvin H. Boone, Winthrop, both of Minn.

[73] Assignee: Palm Sales, Inc., Grove City, Minn.

[21] Appl. No.: 304,489

[22] Filed: Sep. 12, 1994

[51] Int. Cl.[6] ..... A01B 35/18; E01C 19/38

[52] U.S. Cl. ..... 37/142.5; 172/40; 404/117

[58] Field of Search ..... 37/104, 142.5, 37/403; 171/16; 172/40, 42, 554; 404/117, 121, 127, 133.2

[56] References Cited

U.S. PATENT DOCUMENTS

| | | | |
|---|---|---|---|
| 2,891,335 | 6/1959 | Linneman | 37/146 |
| 3,096,896 | 7/1963 | Norton et al. . | |
| 3,471,953 | 10/1969 | Wyatt | 37/142.5 |
| 3,703,128 | 10/1990 | Fransson . | |
| 3,909,149 | 9/1974 | Century | 404/133 |
| 3,930,741 | 1/1976 | Berry | 404/133 |
| 4,066,374 | 1/1978 | King | 404/117 |
| 4,098,344 | 7/1978 | Johnson | 172/40 |
| 4,224,033 | 9/1980 | St. Louis | 404/117 X |
| 4,269,535 | 5/1981 | Schultz | 404/117 |
| 4,278,368 | 7/1981 | Livesay | 172/40 X |
| 4,411,081 | 10/1983 | King | 37/117.5 |
| 4,610,567 | 9/1986 | Hosking | 404/121 |
| 4,892,155 | 1/1990 | Wanamaker | 172/199 |
| 4,913,581 | 4/1990 | Weiter | 172/40 X |

*Primary Examiner*—Terry Lee Melius
*Assistant Examiner*—Robert Pezzuto
*Attorney, Agent, or Firm*—Westman, Champlin & Kelly

[57] ABSTRACT

A vibratory compactor mounts onto the loader arms of a skid steer, and includes a freely turning packing wheel that is vibrated at a desired frequency and intensity. The vibrator and the packing wheel are mounted onto a subframe which in turn is mounted through isolation mounts back to a main frame that attaches to a skid steer loader so that the vibrations generated are not transferred at substantial levels back to the skid steer loader. The compactor includes a blade member that will move loose dirt into a trench that is being compacted by the packing wheel. The mounting for the packing wheel also can be adjusted to tilt the plane of the wheel, and the wheel can be moved laterally as well, to position the packing wheel close to fences or walls.

20 Claims, 7 Drawing Sheets

72
74
VIBRATOR
V
P
54
56
70
58
60
80
87
62
63
82
52
64
18
18A
68
66A
55
64A
16
10
66
76

TRENCH COMPACTOR

BACKGROUND OF THE INVENTION

The present invention relates to a trench compaction device utilizing a rotating wheel that mounts onto the front of a skid steer loader, and is laterally adjustable relative to the loader as well as including vibration isolation members to isolate the vibrations from the skid steer loader.

In the prior art there have been many trench to compaction devices using vibratory wheels for compacting material into the bottom of trenches. Such devices have been mounted onto self-propelled loaders. U.S. Pat. No. 3,471,953 illustrates such a combination, using a complex mounting structure, but it does not teach vibrating the rotating member.

U.S. Pat. No. 4,610,567 shows a trench compaction device that utilizes a plurality of wheels in a side by side location and the wheels are mounted on the front end of a self-propelled loader.

U.S. Pat. No. 4,411,081 illustrates a sheep's foot device that mounts onto the edge of a bucket of a self-propelled loader and has a vibratory connection to the rotating sheep's foot wheels. It also illustrates a type of vibration isolation assembly.

U.S. Pat. No. 4,892,155 illustrates a leveling device that goes onto the front of a skid steer loader, which utilizes a roller across the front of the unit.

Lateral adjustments of a fork lift are well know as illustrated in U.S. Pat. No. 3,096,896, and a vibratory compaction tool having shoes of different widths that are attachable to a shank which extends into a trench is shown in U.S. Pat. No. 3,930,741.

Various isolation mounts have also been advanced for vibrating packers. The present invention provides a vibrating packing wheel used in a maneuverable trench compacting unit which has adjustability to suit a wide number of jobs and minimizes the vibration back to the mounting structure on a skid steer loader.

The trench compactor also, in a modified form, is capable of being inclined so that the plane of rotation of the packing wheel is inclined relative to a horizontal plane (or vertical plane). In other words, the packing wheel can pack trenches at angles, by adjusting a mounting plate. The operation would be exactly the same, but it widens the versatility of the unit to be able to have the wheel travel at an angle.

SUMMARY OF THE INVENTION

The present invention relates to a rotatable, non-powered packing or tamping wheel that is mounted onto a vibrating subframe for packing the bottom of trenches. The vibrating subframe is connected through isolation couplings to a box type main frame that in turn is mounted onto an attachment plate of a skid steer loader. The mounting permits lateral adjustment of the packing wheel. In addition, the wheel has adjustable, replaceable packing shoes or feet, and the overall system incorporates a controllable back filling blade system that will permit back filling the trench at the same time the packing is taking place.

The packing or tamping wheel has adjustable pads or shoes on the outer periphery that can be moved laterally (parallel to the rotational axis of the wheel) to accommodate different width trenches, by offsetting the pads that sequentially engage the ground. These pads or shoes also are replaceable and can be changed as desired.

As shown, the mounting to the skid steer loader includes a pivot assembly that permit including the plane of rotation of the packing wheel relative to a vertical plane. This permits the wheel to operate at an angle relative to the ground surface.

The compactor is easily mounted onto a skid steer loader and provides a wide range of positioning, vibration, and back filling capabilities. The isolation device makes sure that the vibrations that are needed for doing a good packing or tamping job at the wheel, do not seriously or adversely affect the skid steer loader.

DETAILED DESCRIPTION OF THE PREFERRED EMBODIMENTS

Figure 1:
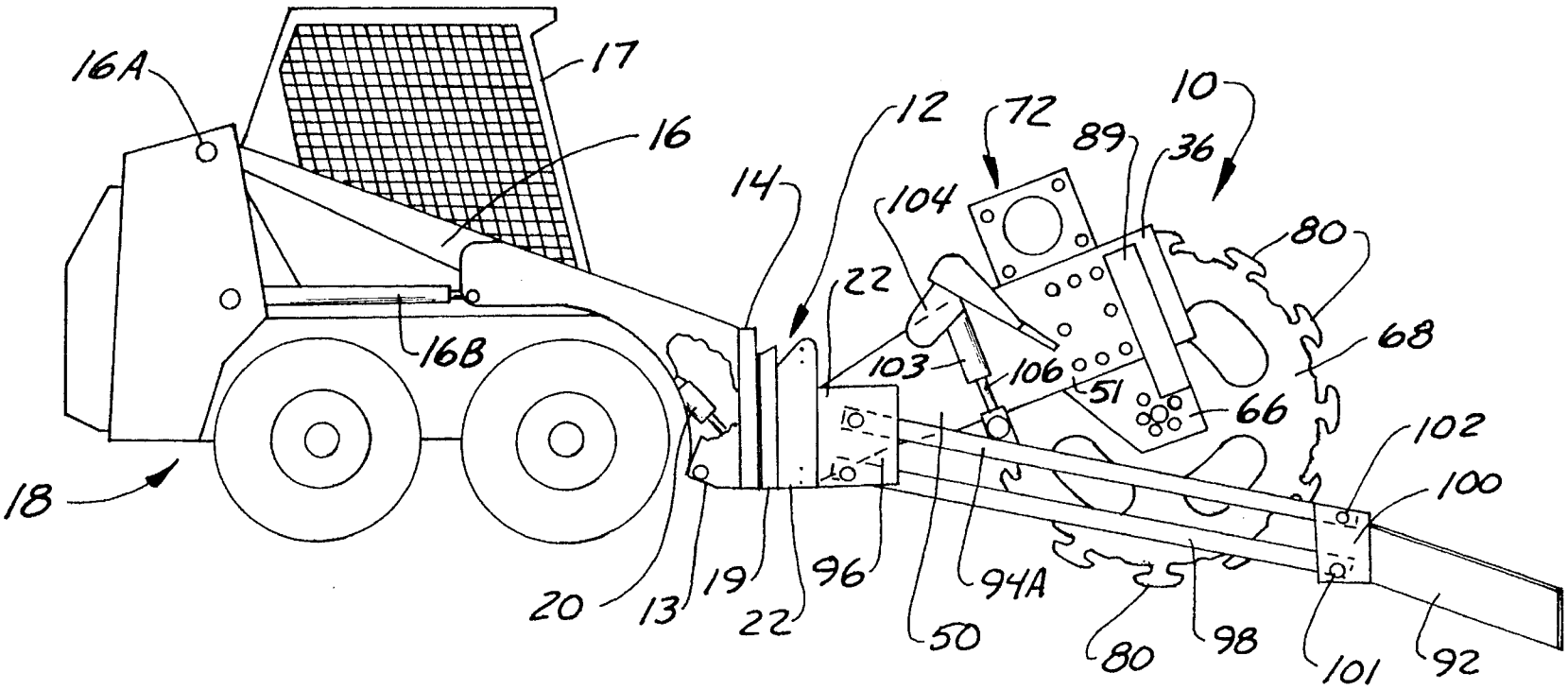
FIG. 1 is a part schematic side view of a trench compactor made according to the present invention installed on a skid steer loader.

A trench compactor assembly indicated generally at 10, as shown, is mounted onto an adapter frame assembly 12 that is made to attach to what is commonly known as a quick attach plate 14 conventionally made and held by pivot pins 13 at the front ends of lift arms 16 of a self-propelled loader 18, as shown, a skid steer loader. The lift arms 16 are mounted to frame uprights 15 on pivots 16A.

The quick attach plate 14 is adjustable about a horizontal axis on pins 13 through the use of a tilt hydraulic cylinder indicated at 20, only schematically, but it is sufficient to provide for tilting the quick attach plate 14 from a normal vertical position. The lift arms 16 can be raised and lowered in a normal manner using lift cylinder 16B. Hydraulic pumps and controls are in an operator's cab 17.

A frame support plate 22 forms part of the adapter frame assembly 12 and extends laterally across the front of the skid steer loader. A quick attach adapter 19 having latch brackets 19A for attachment to the quick attach plate 14 is fixed to the rear side of frame support plate 22. A pair of parallel slide rails or tubes 26, 26 have first ends supported on suitable brackets 28 on the front of frame support plate 22. The frame support plate has end support flanges 32, and second ends of the rails 26 are secured to one of the end support flanges 32 with brackets 30.

A slide plate 33 has a pair of sleeves or hubs 35 that slidably mount over the respective rails 26, so that the slide plate 33 will be permitted to move laterally of the skid steer loader along the rails 26 from adjacent the brackets 30 to adjacent the brackets 28. The slide plate 33 supports a back plate 34 to which the forwardly extending main frame member 36 is welded or fixed. The frame member 36 and its supported components, as will be explained, can be moved laterally under control of a hydraulic cylinder 38 that includes a rod 40 mounted to an internal piston (not shown). The rod is connected to a bracket 42 fixed to the slide plate 33. The base of the cylinder 38 is attached to brackets 44 that are fixed to end flange 32 at the opposite end of the frame support plate 22 from the brackets 30. By controlling the cylinder 38 through the use of a suitable valve 46, from an auxiliary hydraulic connection of the skid steer loader, the lateral (side to side) position of the trench compacting device can be changed so that it can be moved over to one edge of the skid steer loader to provide for tamping in a trench that is closely adjacent to a fence or wall.

Figure 2:
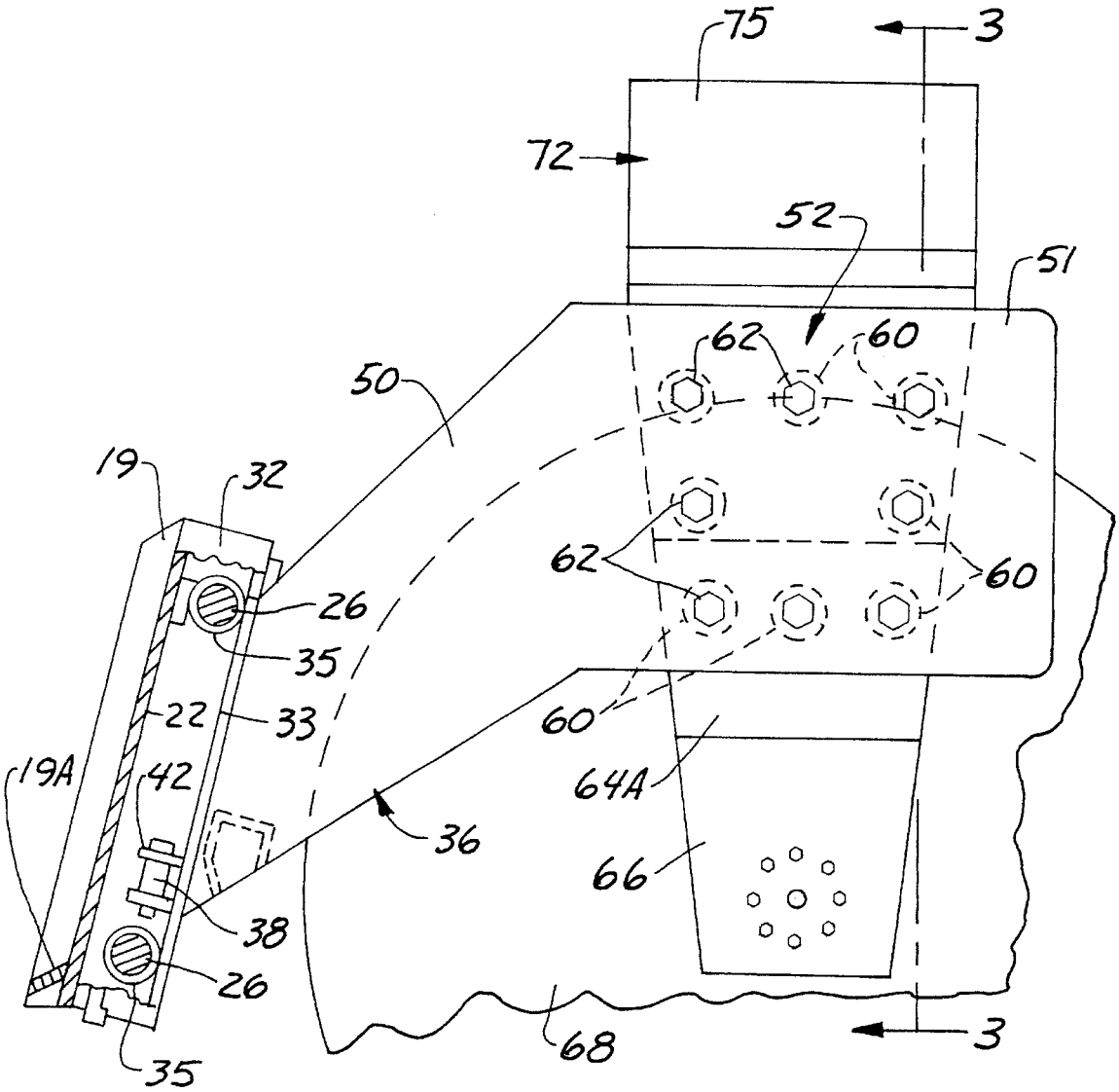
FIG. 2 is an enlarged side elevational view of the frame assembly of the present invention.

The back plate 34 is used for mounting the main frame 36. The main frame 36 an upwardly and forwardly extending portion 50. A top plate is fixed to side plates of portion 50 to form the frame portion 50 into an inverted channel and cross braces at the lower edge of the side plates form a box like section. When the back plate 34 is generally vertical as shown in FIG. 1, frame portion 50 extends upwardly substantially. Note that in FIG. 2 the back plate 34 and the frame support plate 22 are tilted, so that a forward portion 52 of the main frame 36 has top edges that are generally horizontal.

The forward portion 52 has side plates 51 that are joined together with top and bottom plates 54 and 55 to make a box frame. The top and bottom plates 54 and 55, respectively, have openings 56 near the outer ends to the openings 56 are in both the top and bottom plates and are of size to permit a subframe assembly 58 to be positioned in the openings without contacting the edges.

The subframe assembly 58 is supported on the side plates 51 through the use of a plurality of vibration dampening or isolating bushings indicated at 60. The isolating bushings 60 are of suitable vibration absorbing rubber or elastomer and can have molded in threaded inserts that will receive cap screws 62 extending through openings in side plates 51 into first ends of the isolating bushings 60.

The subframe 58 has a pair of upright plates 64 which are for attached with cap screws 63 to the inner ends of the vibration isolating bushings 60. The plates 64 taper inwardly at lower ends 64A, and are joined to upright leg portion 66 of brackets that are positioned on opposite sides of a packing or tamping wheel 68. The leg portions 66 have upper end portions 66A above the leg portions 64A, which extend outwardly, and are welded to the upright side plates 64. The lower ends of the lower tapered portion 64A of side plates 64 also are welded to the upright leg portions 66. The only connection between the side plates 51 of the main frame and the subframe 58 is through the vibration isolating bushings 60.

A heavy top plate 70 is mounted onto the upright plates 64, and fits within the opening 58 in the top wall 56 of the main frame 36. A vibrator assembly 72 is mounted onto the plate 70. The vibrator assembly is as shown a variable speed hydraulic motor 74 which drives eccentric weights in an oil bath in a housing 75 to provide vibration at a desired intensity that will shake or vibrate the plate 70 and the plates 64, leg portions 66 and the packing wheel 68. The vibration mode is selected so that it is generally vertical in its greatest magnitude, to apply a vibrating force to the packing wheel 65.

The packing or tamping wheel 68 is mounted on a suitable bearing assembly 76 to lower ends of the leg portions 66. The packing wheel 68 freely rotates on the bearing assembly 76 relative to leg portions 66. The packing wheel 68 has a plurality of radially extending projections 84 spaced around its periphery and there are support plates 82 mounted at the outer ends of the radially extending projections 84. A pad or shoe 80 is mounted onto each support plate 82. The shoes or pads 80 have slots 86 which receive cap screws 85 which thread into provided threaded apertures in the respective plate 82. The slots 86 permit the pads to be adjusted laterally, that is, in direction along the axis or rotation of the packing wheel 68, relative to the plates 82. The pads 80 also can be replaced with different size pads as desired. The shoes or pads 80 have a raised tamping block 87 in the center portions of the pad.

A pair of guide arms 89 are fixed to the side plates 51 of the frame 36 and have ends extending in toward the leg portions 66. The inwardly extending ends are spaced from, and not fixed to the leg portions 66, but will limit the amount of side to side movement of the leg portions 66 and thus the wheel 68.

Figure 4:
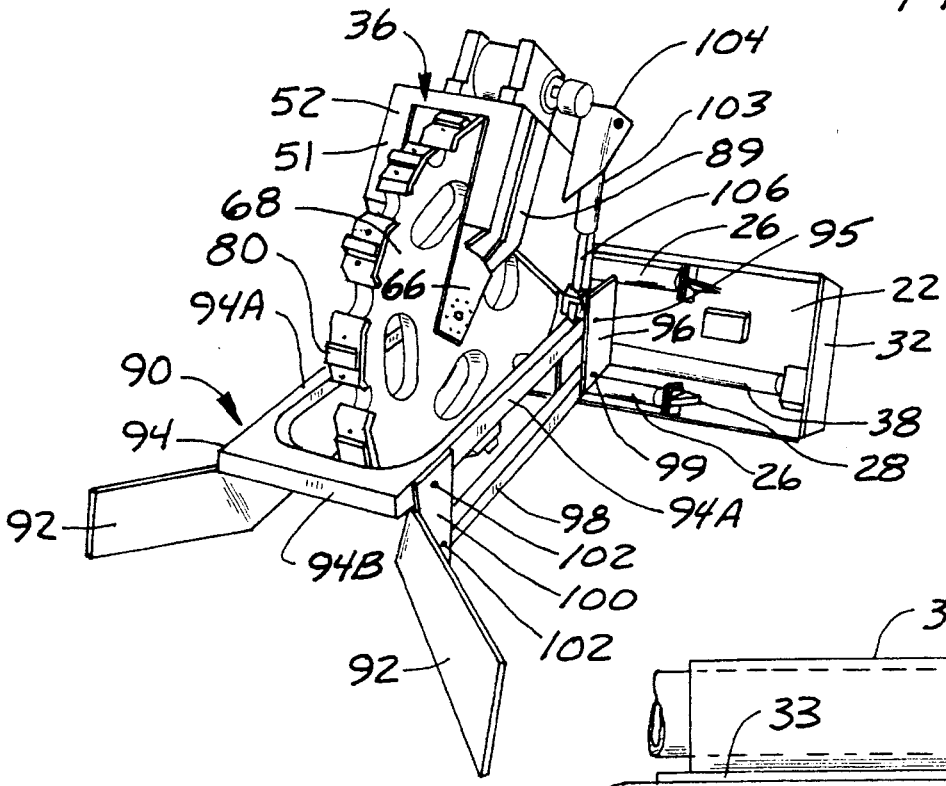
FIG. 4 is a perspective view of the assembly of the present invention.
Figure 5:
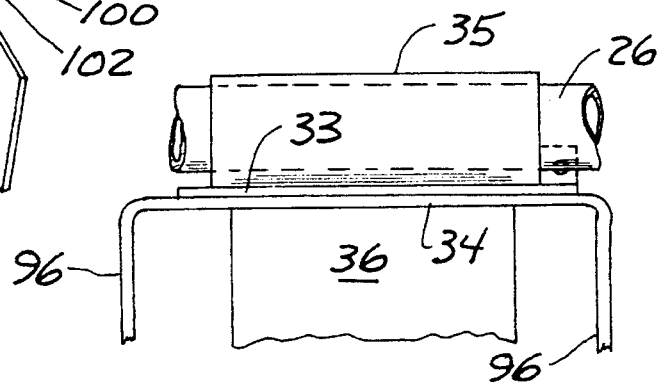
FIG. 5 is a fragmentary top view of a sliding support for a compactor wheel support frame.
Figure 6:
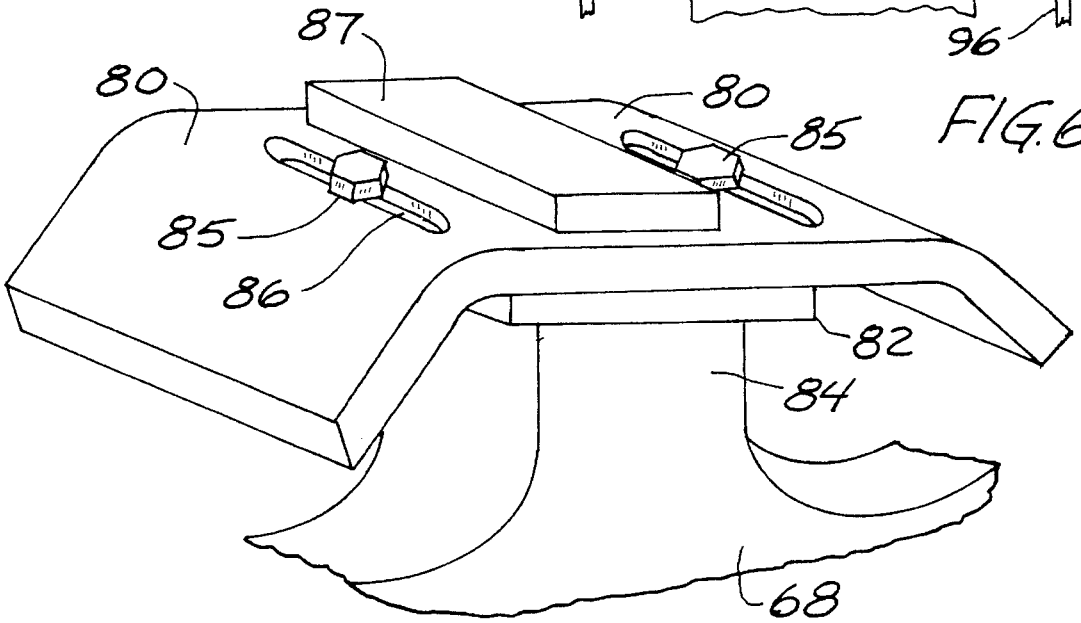
FIG. 6 is an enlarged detailed view of a computer foot.

The compacting device has a back filling blade assembly 90 mounted onto the slide plate 33 as shown in FIGS. 1 and 4. A pair of blades 92 that are formed like wings are mounted to a U shaped upper frame 94 which has side links 94A, 94A and a front cross member 94B. The rear portions of the links 94A are pivotally mounted as at 95 to plates 96 that are supported on the slide plate 33. A pair of lower parallel links 98 on opposite sides of the frame assembly 90 are pivotally mounted as at 99 to the plates 96, and are pivotally mounted at 101 to a pair of plate portions 100 which in turn are pivotally mounted as at 102 to the upper U shaped frame 94. The plate portions 100 directly support blades 92.

The position of the parallel linkage frame 90 is controlled by a pair of hydraulic cylinders 103 that have base ends mounted onto supports 104 which in turn are supported on the main frame 36. Ends of provided extendible and retractable rods 106 of cylinders 103 are connected to suitable brackets on the upper links 94A, as shown in FIG. 4. The rods 106 extend and retract to lift and lower the wing type blades 92. The blades 92 can be raised if desired, and also forced against the ground with a substantial force. They make back filling easy to accomplish. The blades 92 are optional accessories.

Figure 8:
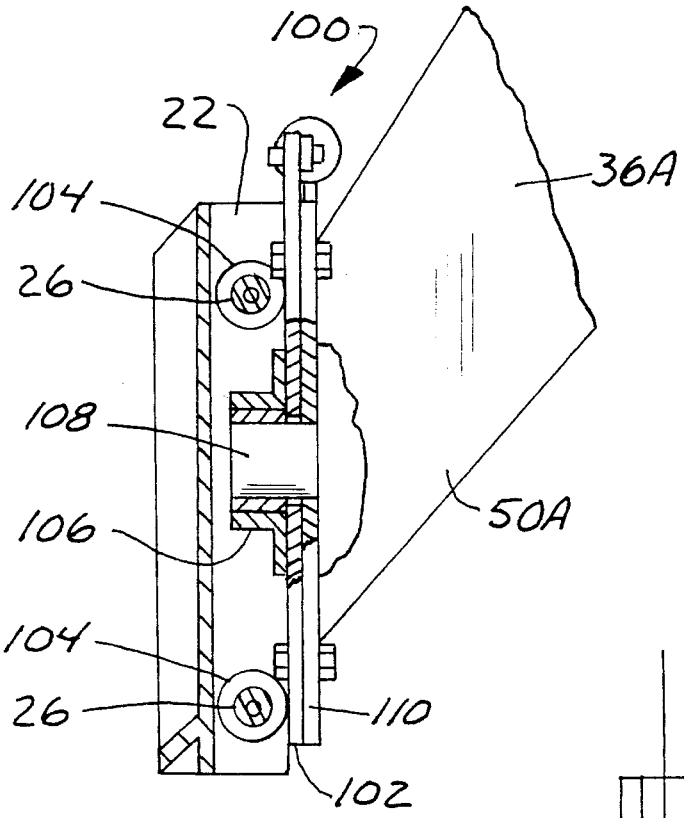
FIG. 8 is a fragmentary part sectional side view of a mounting assembly used with a trench compactor of the present invention.

A modified form of the invention is shown in FIGS. 8–12. The basic structure of the main frame 36 and the tamping or packing wheel 68, having pads 80 Chat will pack or tamp material in a trench is the same as in the first form of the invention. The mounting to the frame support plate 22 that is part of an adapter frame assembly is modified to permit the rotational plane of the packing wheel 68 to be inclined relative to a vertical plane so that tamping or packing at an angle is possible for getting into corners, or for other purposes. In FIG. 8, the upright frame member shown at 50A corresponds to the frame member 50, and the packing assembly shown in FIG. 11 at 10A is essentially the same as that shown in the previous form of the invention, and is mounted onto the upright frame member 50A of the main frame 36A in the same manner. The vibrating member is mounted on the top of the frame as well. The support plate 22 is shown in FIG. 8, and both of the parallel slide rails or tubes 26 are used as in the first form of the invention.

Figure 9:
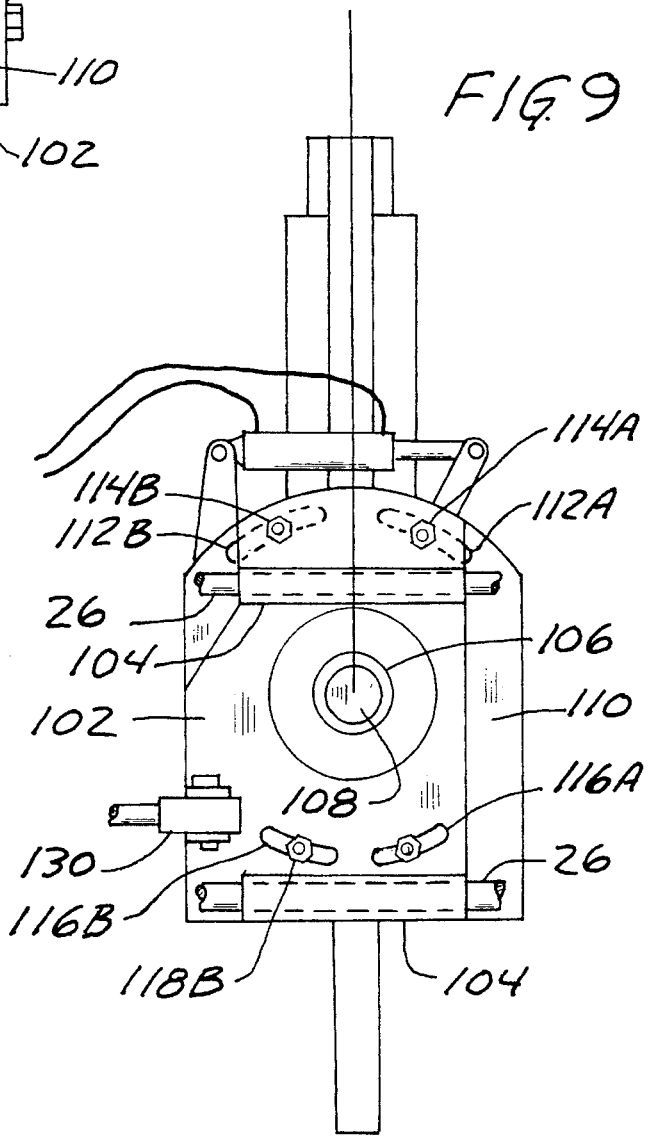
FIG. 9 is a rear view of a mounting bracket assembly shown in FIG. 8.

In this form of the invention, a frame mounting assembly 100 is utilized, and includes a plate 102 that has cross hubs 104 welded thereto. The hubs 104 are made to slide along the rails or tubes 26. The plate 102 mounts a center pivot hub 106, which in turn receives a stub shaft 108 that is fixed to a forward adjustment plate 110. The frame member 50A is welded to front plate 110, as can be seen in FIG. 8. Stub shaft 108 then is able to rotate in the hub 108. Suitable hubs 106 can be made for providing a guiding and support function, and can include bearings or bushings, if desired, but the frame or the plate 110 is held to the base plate 101 through the use of four cap screws, as perhaps best shown in FIGS. 9, 10 and 11. Referring specifically to FIG. 9, it can be seen that the plate 110 is wider than the plate 102, and at the top of the plate 110 there are a pair of slots 112A and 112B that are formed on an arc about the center of the shaft 108.

Cap screws indicated at 114A and 114B extend through apertures in the plate 102 and through the slots 112A and 112B, and can be tightened to clamp the two plates 102 and 110 together to secure the plates together.

The plate 102 has curved slots 116A and 116B formed near the bottom of the plate, and cap screws 118A and 118B pass through apertures in the front plate 110 and through the slots 116A and 116B and are tightened to clamp the bottom portions of the plates 102 and 110 together.

Figure 10:
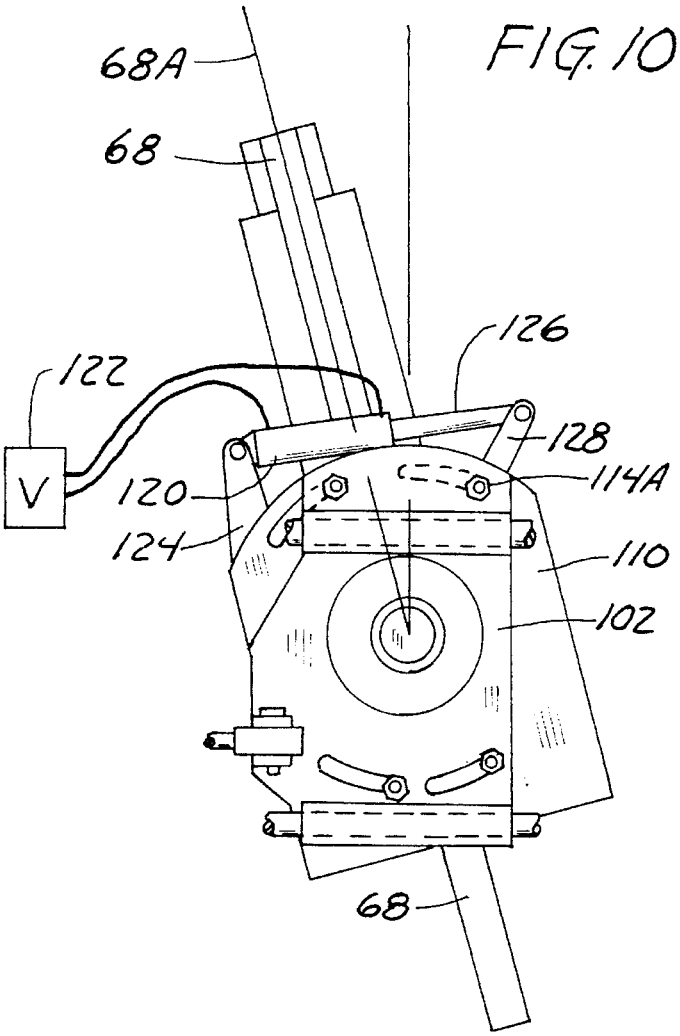
FIG. 10 is a view of the bracket assembly in FIG. 9 with the compactor wheel inclined in a first direction relative to a vertical plane.

It can be seen that if the cap screws 114A, 114B, 116A, and 116B are loosened, the two plates 102 and 110 can be tilted relative to each other from a normal centered position shown in FIG. 9, by rotating plate 110 and shaft 108 as supported in the hub 106 relative to the plate 102. In FIG. 10, the packing wheel 68 is positioned with its center or rotational plane shown at 68A inclined relative to a vertical plane in a counter clockwise direction when looking forwardly. The cap screws 114A and 114B are at the ends of the slots 112A and 112B, respectively, in plate 110, and the cap screws 118A and 118B are at the ends of the slots 116A and 116B. This is the maximum amount of tilt of the plate 110 relative to the plate 102.

The shifting of the plates 102 and 110 can be accomplished by operating a hydraulic actuator 120, through a suitable valve 122 (FIG. 10). The actuator 120 has a base end mounted to an upright arm 124 that is fixed to the plate 110, and it has an extendible and retractable rod 126 that is attached to an arm 128 which is fixed to the plate 102. In the position shown in FIG. 10, the rod 126 has been extended to move the arm 128 counter clockwise as shown, until the cap screws 114A and 114B, and 116A and 116B are the at ends of the slots on the opposite plate.

Figure 11:
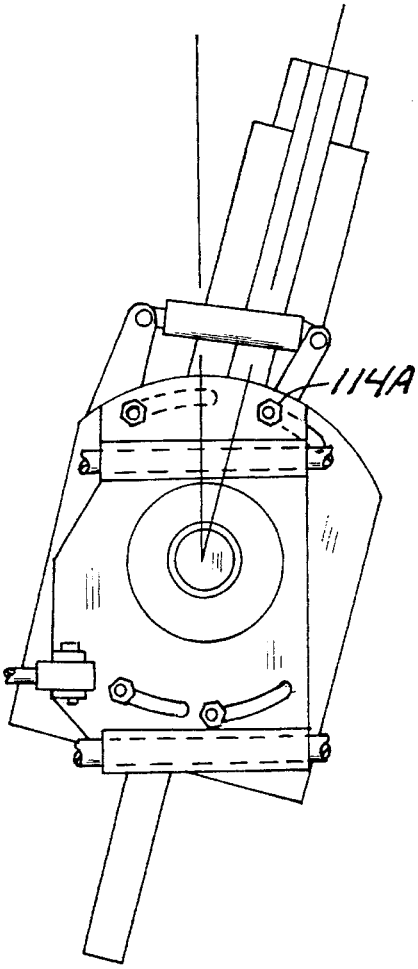
FIG. 11 is a view of the mounting assembly of FIG. 9 with the compactor wheel inclined in an opposite direction from FIG. 10.
Figure 12:
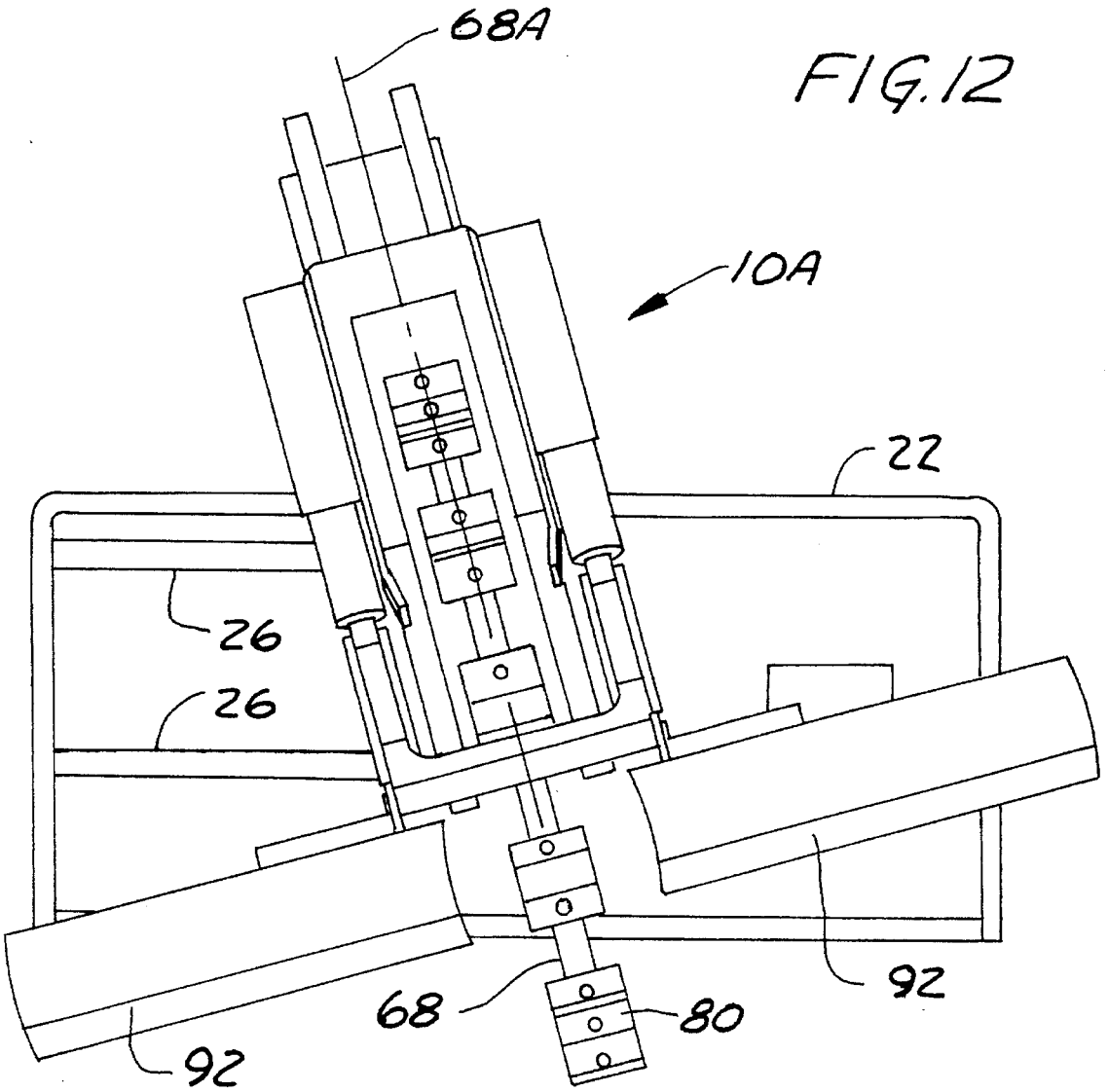
FIG. 12 is a front elevational part schematic view of the modified form of the invention showing a compactor wheel inclined as in FIG. 11.

The actuator 120 can be retracted, after the cap screws holding the two plates together have been loosened, to the position shown in FIGS. 11 and 12. In this view, the plate 110 has been moved clockwise the maximum amount so that the cap screws 114A and 114B are at the opposite ends of the slots 112A and 112B from that shown in FIG. 10 and likewise the cap screws 118A and 118B are at the opposite ends of the slots 116A and 116B.

Figure 7:
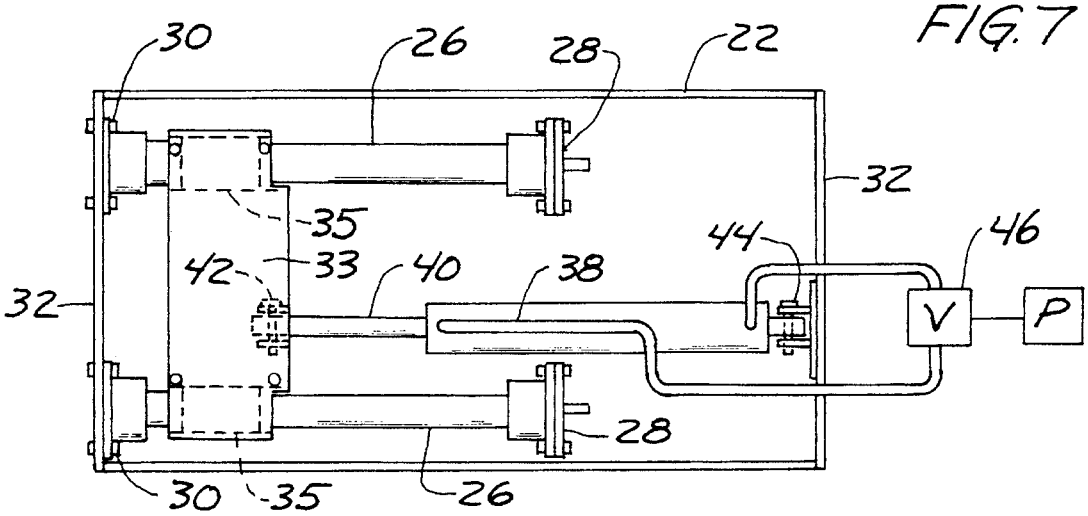
FIG. 7 is a part schematic front view of a mounting plate used with the present invention illustrating a transversely slidable mounting.
Figure 3:
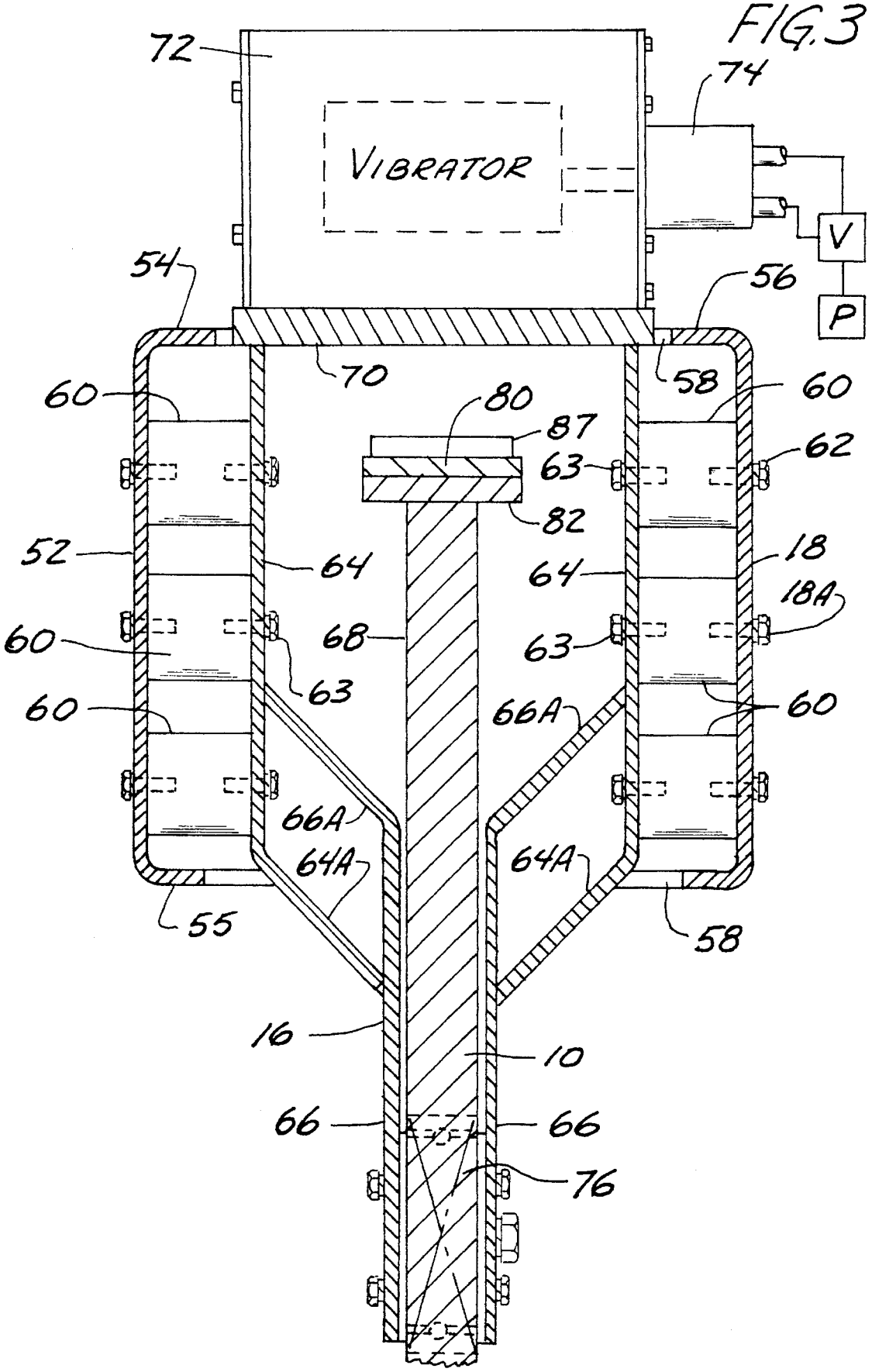
FIG. 3 is a sectional view taken as on line 3—3 of FIG. 2.

A rod end shown schematically at 130 represents the rod for the actuator 38 shown in FIG. 7 for example and is used for sliding the hubs 104 and the plate 102 and supported equipment along the rails or tubes 26 to adjust the lateral position of the packing wheel.

In FIG. 12, the packing wheel 68 has the pads 80 on it, and the pads will go into a trench at an angle, this will permit some additional lateral packing range. The backfilling blades 92 also are shown, and it can be seen that they will incline the same amount as the packing wheel deal. Of course they can be lifted as well if desired. The individual back filling blades 92 can be raised and lowered independently by operating the separate actuators on each side of the frame, and the packing wheel 68 can be placed at an angle relative to a horizontal surface and used for packing or tamping. It should be noted that after the plate 110 has been pivoted to its desired position to angle the plane of the packing wheel 68 a desired amount, the cap screws 114A, 114B, 118A and 118B are then tightened down again to positively clamp the two plates 102 and 110 mounting the frame member 50A in position.

In operation, the compacting device is made so that the packing wheel 68 can be placed into a trench, and then the skid steer loader can be moved forwardly and rearwardly while the vibrator assembly is energized to vibrate the packing wheel 68 so that the pads 80 will pack and vibrate dirt into the bottom of the trench. The wing type blades 92 will fill in the trench ahead of the packing wheel 68, and the material that is filled into the trench will be thus packed.

The packing wheel 68 can be adjusted as to vertical elevation and downward load by operating the loader arms for the skid steer loader, through the use of hydraulic cylinders 16B and through the use of the tilt cylinder 20 that will tilt the attachment plate 14 about a horizontal axis and thus the frame 36. An angular position of the plane of the tamping wheel can be adjusted as explained.

The packing wheel 68 can be placed over to one lateral side of the skid steer loader, as shown, or slid in toward the center line of the skid steer loader so that the skid steer loader will straddle the trench easily. The pads 80 can be adjusted more to one side or the other relative to the center plane of wheel 68. Thus, a substantial adjustment in the width of the packing track can be maintained.

The trench packing device of the present invention provides adequate force for vibrating and packing in dirt that is moved into the trench by the wing type blades 92. It operates from above ground level to about 27 inches depth.

Various types of vibrators can be utilized, but using rigid housing with all parts running in oil keeps the vibrator operating a long time, and isolation mounts isolates the vibrator and the vibrating packing wheel from the main compactor frame and the skid steer loader.

Although the present invention has been described with reference to preferred embodiments, workers skilled in the art will recognize that changes may be made in form and detail without departing from the spirit and scope of the invention.

What is claimed is:

1. A vibratory compactor for narrow trenches for use in combination with a skid steer loader having a hydraulically operated loader arm and a forward attachment plate supported on the loader arm, the attachment plate extending laterally of the skid steer loader and having a laterally extending guide rail supported thereon and extending across the attachment plate, the vibratory compactor having a first frame mounted on the guide rail of the forward attachment plate and being, positionable along the guide rail;

a packing wheel adapted for rolling movement in a trench;

a subframe, said subframe rotatably mounting said packing wheel for free rotation during compaction;

a vibrator for vibrating said subframe and packing wheel at a desired intensity as the packing wheel toils in a trench; and vibration isolation means mounting said subframe relative to said first frame to isolate vibrations of the vibrator from being transferred back to the attachment plate.

2. The compactor of claim 1, wherein said first frame has a pair of spaced side members, and having top and bottom openings, and the subframe being positioned in and extending through the openings.

3. The compactor of claim 1, wherein the first frame has a pair of spaced side members and the subframe has a pair of spaced side plates, the side plates of the subframe extending generally parallel to the side members of the first frame, and the vibration isolation means comprising a plurality of elastomeric bushings having first ends connected to inner surfaces of the side members of the first frame, and second ends connected to the side plates of the subframe, to solely support the subframe relative to the first frame through said elastomeric bushings.

4. The compactor of claim 3, and a support member between the forward attachment plate and the guide rail for the first frame including a pair of angularly adjustable members, one on the attachment plate and one on the first frame, the angularly adjustable members being rotatable about an axis substantially parallel to an axis of rotation of the packing wheel to permit inclining a plane of rotation of the packing wheel relative to a vertical plane.

5. The compactor of claim 2, and guide members fixed to said side members of said first frame and extending to be adjacent the subframe to limit side to side vibrations of the subframe.

6. The compactor of claim 1, wherein said packing wheel has a plurality of packing shoes mounted thereon at spaced locations around an outer periphery thereof, said mounting shoes being adjustable laterally relative to a central plane of said packing wheel.

7. The compactor of claim 6, wherein said packing wheel is a planar member having integral projections at the outer periphery thereof and spaced around the periphery, and said packing shoes being mounted on said projections.

8. The compactor of claim 7, wherein the packing shoes have elongated slots therein, and are bolted to the projections so that the elongated slots permit the shoes to slide laterally of the projections.

9. The compactor of claim 1, and an angled blade on at least one side of the packing wheel, positioned such that the blade will move material toward a trench being compacted when the vibratory compactor moves in a selected direction.

10. The compactor of claim 1, wherein there are two vertically spaced, laterally extending, guide rails supported on the attachment plate and the vibratory compactor has support hubs slidably mounted to the guide rails for movement laterally of the skid steer loader on which it is mounted.

11. The compactor of claim 10 and a hydraulic cylinder to selectively move said first frame laterally along said rails.

12. The compactor of claim 9, wherein the angled blade is movably mounted on the frame, and a hydraulic cylinder to permit raising and lowering said blade relative to the first frame.

13. The compactor of claim 12, wherein said blade is mounted to the first frame through a parallel linkage.

14. The compactor of claim 10, including a frame support plate for mounting to the forward attachment plate of a skid steer loader, said frame support plate extending laterally across the skid steer loader, and having a pair of end plate; thereon, the guide rails being mounted to the end plates and extending therebetween.

15. The compactor of claim 1, wherein said vibrator comprises a variable speed drive hydraulic motor.

16. The compactor of claim 1, wherein the vibratory compactor is mounted to the forward attachment plate by an adjustable support, the support having an adjustment member movable about a generally horizontal axis to change the angle of the packing wheel is relative to a vertical plane.

17. A vibratory compactor for narrow trenches for use in combination with a mobile loader having a hydraulically operated loader arm, the vibratory compactor comprising:

a main frame for mounting to the loader arm;

a packing wheel adapted for rotatable movement in a trench;

a subframe rotatably mounting said wheel;

a vibrator attached to the subframe for vibrating said subframe as the packing wheel engages soil to be compacted;

the main frame having a pair of spaced part side plates, and the subframe having a pair of side plates for supporting the packing wheel, the subframe side plates being positioned between the main frame side plates; and a plurality of elastomeric isolators having first ends attached to the main frame side plates and second ends attached to the subframe side plates to mount the subframe to the main frame and to isolate vibrations from the vibrator from being transferred back to the main frame.

18. A vibratory compactor for narrow trenches for use in combination with a prime mover, the vibratory compactor comprising:

a first frame;

a packing wheel mounted to the first frame for rotational movement and for movement in a trench;

a vibrator for vibrating said packing wheel as the packing wheel rolls; and a support assembly between the prime mover and the first frame including members adjustable to permit a center plane of rotation of the packing wheel to be inclined relative to a generally vertical plane.

19. The compactor of claim 18, wherein the first frame includes a subframe on which the packing wheel is rotationally mounted and vibration isolation means comprising a plurality of elastomeric bushings supporting the subframe relative to other portions of the first frame.

20. The compactor of claim 18 wherein the prime mover is a skid steer loader, and the first frame is mounted on an attachment plate of such a skid steer loader.

* * * * *

UNITED STATES PATENT AND TRADEMARK OFFICE

CERTIFICATE OF CORRECTION

PATENT NO. : 5,526,590

DATED : June 18, 1996

INVENTOR(S) : Palm et al.

It is certified that error appears in the above-indentified patent and that said Letters Patent is hereby corrected as shown below:

Column 6, line 67, please delete "toils" and insert --rolls--.

Column 8, line 4, please delete "plate;" and insert --plates--.

Signed and Sealed this

Seventeenth Day of December, 1996

*Attest:*

*Attesting Officer*

BRUCE LEHMAN

*Commissioner of Patents and Trademarks*